US010934821B2

(12) United States Patent
Iyer et al.

(10) Patent No.: US 10,934,821 B2
(45) Date of Patent: Mar. 2, 2021

(54) SYSTEM AND METHOD FOR EXTRACTING RESOURCES FROM A RESERVOIR THROUGH CUSTOMIZED RATIOS OF FLUID AND GAS INJECTIONS

(71) Applicant: General Electric Company, Schenectady, NY (US)

(72) Inventors: Naresh Sundaram Iyer, Schenectady, NY (US); Steven Hector Azzaro, Niskayuna, NY (US); Glen Richard Murrell, Oklahoma City, OK (US); Robert Carl Lloyd Klenner, Oklahoma City, OK (US)

(73) Assignee: Baker Hughes Oilfield Operations, LLC, Houston, TX (US)

( * ) Notice: Subject to any disclaimer, the term of this patent is extended or adjusted under 35 U.S.C. 154(b) by 466 days.

(21) Appl. No.: 14/808,636

(22) Filed: Jul. 24, 2015

(65) Prior Publication Data

US 2016/0069169 A1 Mar. 10, 2016

Related U.S. Application Data

(60) Provisional application No. 62/047,709, filed on Sep. 9, 2014.

(51) Int. Cl.
*E21B 43/16* (2006.01)

(52) U.S. Cl.
CPC ..... *E21B 43/166* (2013.01); *E21B 43/164* (2013.01)

(58) Field of Classification Search
CPC ..... E21B 43/164
USPC ..... 166/402, 268, 308, 90.1, 260, 263, 266
See application file for complete search history.

(56) References Cited

U.S. PATENT DOCUMENTS

| | | | | |
|---|---|---|---|---|
| 3,525,395 | A | 8/1970 | Chew | |
| 3,599,717 | A | 8/1971 | Mcmillen | |
| 5,421,408 | A | 6/1995 | Stoisits et al. | |
| 6,039,116 | A | 3/2000 | Stevenson et al. | |
| 6,053,249 | A | 4/2000 | Stevenson et al. | |
| 6,325,147 | B1 | 12/2001 | Doerler et al. | |
| 2003/0062159 | A1* | 4/2003 | Nasr | C09K 8/592 166/272.1 |
| 2006/0180306 | A1* | 8/2006 | Stone | E21B 43/166 166/252.6 |
| 2012/0125616 | A1* | 5/2012 | Graue | E21B 41/0064 166/305.1 |
| 2013/0175031 | A1* | 7/2013 | Kerr | E21B 43/2408 166/272.3 |
| 2016/0177686 | A1* | 6/2016 | Carvajal | E21B 43/12 700/282 |

* cited by examiner

*Primary Examiner* — Silvana C Runyan

(57) ABSTRACT

A system and method for extracting a resource from a reservoir repeatedly alternates between injecting a fluid and injecting a gas into the reservoir. A rate and/or an amount of each of the fluid and the gas that is injected into the reservoir is defined by a first fluid-and-gas ratio function that designates different ratios as a function of time. The ratios designate the rate and/or the amount of the fluid that is injected into the reservoir to the rate and/or the amount of the gas that is injected into the reservoir. The rate and/or the amount at which the fluid and/or the gas is injected into the reservoir is changed according to the ratios designated by the first fluid-and-gas ratio function as time progresses.

20 Claims, 6 Drawing Sheets

SYSTEM AND METHOD FOR EXTRACTING RESOURCES FROM A RESERVOIR THROUGH CUSTOMIZED RATIOS OF FLUID AND GAS INJECTIONS

CROSS-REFERENCE TO RELATED APPLICATIONS

This application claims priority to U.S. Provisional Application No. 62/047,709, which was filed on 9 Sep. 2014, is titled "A System And Method For Parametric Representation And Evaluation Of WAG Schemes To Enable Field-Specific Recovery Optimization," and the entire disclosure of which is incorporated herein by reference.

FIELD

Embodiments of the subject matter described herein relate to systems and methods that extract resources from subterranean reservoirs by injecting fluids and gases into the reservoirs.

BACKGROUND

Carbon dioxide-based tertiary oil recovery is increasingly becoming a popular recovery methodology. This type of recovery involves injecting carbon dioxide (CO2) into a subterranean reservoir to recover oil from the reservoir. Significant volumes of CO2 can be used to extract the oil. Given the volumes of the CO2 that are required to be injected into the reservoir, this type of recovery often occurs in an environment where CO2 is a highly constrained and a supply-limited commodity. This can require operators to make the best possible use of the instantaneous CO2 that is available in the market.

Effective use of CO2 for tertiary oil recovery involves various alternative methods, such as the water-alternating-gas (WAG) method. The WAG method involves periodically alternating the injection of CO2 and water into the reservoir according to a scheme with the intent of sweeping the leftover oil out of the reservoir. Effective use of WAG requires meeting multiple constraints while seeking to increase the rate of oil extraction. Inappropriately designed WAG schemes can result in poor production and early breakthrough of water and/or gas, thereby making the recovery of oil viable only for short periods of time.

BRIEF DESCRIPTION

In one embodiment, a method (e.g., for extracting a resource from a reservoir) comprises obtaining a group of fluid-and-gas ratio functions that is customized for a liquid resource reservoir. The fluid-and-gas ratio functions designate different ratios at which a fluid and a gas are injected into the reservoir to extract a liquid resource from the reservoir. The fluid-and-gas ratio functions designate the ratios as continually changing ratios with respect to time. The method also includes selecting a first fluid-and-gas ratio function and repeatedly alternating between injecting the gas into the reservoir at one or more of a rate or an amount defined by a current ratio of the ratios designated by the first fluid-and-gas ratio function that is selected and injecting the fluid into the reservoir at one or more of a rate or an amount defined by the current ratio. The method also includes changing the ratio at which the fluid and the gas are injected into the reservoir according to the first fluid-and-gas ratio function as time progresses.

In another embodiment, a system (e.g., a resource extraction system) includes a controller configured to obtain a group of fluid-and-gas ratio functions that is customized for a liquid resource reservoir. The fluid-and-gas ratio functions designate different ratios at which a fluid and a gas are injected into the reservoir to extract a liquid resource from the reservoir. The fluid-and-gas ratio functions designate the ratios as continually changing ratios with respect to time. The controller also is configured to select a first fluid-and-gas ratio function and to communicate control signals to a fluid pump and a gas pump in order to repeatedly alternate between directing the gas pump to inject the gas into the reservoir at one or more of a rate or an amount defined by a current ratio of the ratios designated by the first fluid-and-gas ratio function that is selected and directing the fluid pump to inject the fluid into the reservoir at one or more of a rate or an amount defined by the current ratio. The controller is configured to change the ratio at which the fluid and the gas are injected into the reservoir according to the first fluid-and-gas ratio function as time progresses.

In another embodiment, a method (e.g., for generating fluid-and-gas ratio functions) includes obtaining resource extraction parameters related to extracting a liquid resource from a liquid resource reservoir by injecting a fluid and a gas into the reservoir, and customizing a group of fluid-and-gas ratio functions for the reservoir. Each of the ratio functions designates ratios that continually change as a function of time. The ratios designate one or more of a rate or an amount of the fluid that is injected into the reservoir to one or more of a rate or an amount of the gas that is injected into the reservoir. The fluid-and-gas ratio functions are customized based on the resource extraction parameters. The method also includes directing a change in one or more of the rate of the fluid that is injected into the reservoir, the amount of the fluid that is injected into the reservoir, the rate of the gas that is injected into the reservoir, or the amount of the gas that is injected into the reservoir by communicating one or more of the fluid-and-gas ratio functions to a controller that controls the one or more of the rate of the fluid that is injected into the reservoir, the amount of the fluid that is injected into the reservoir, the rate of the gas that is injected into the reservoir, or the amount of the gas that is injected into the reservoir.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
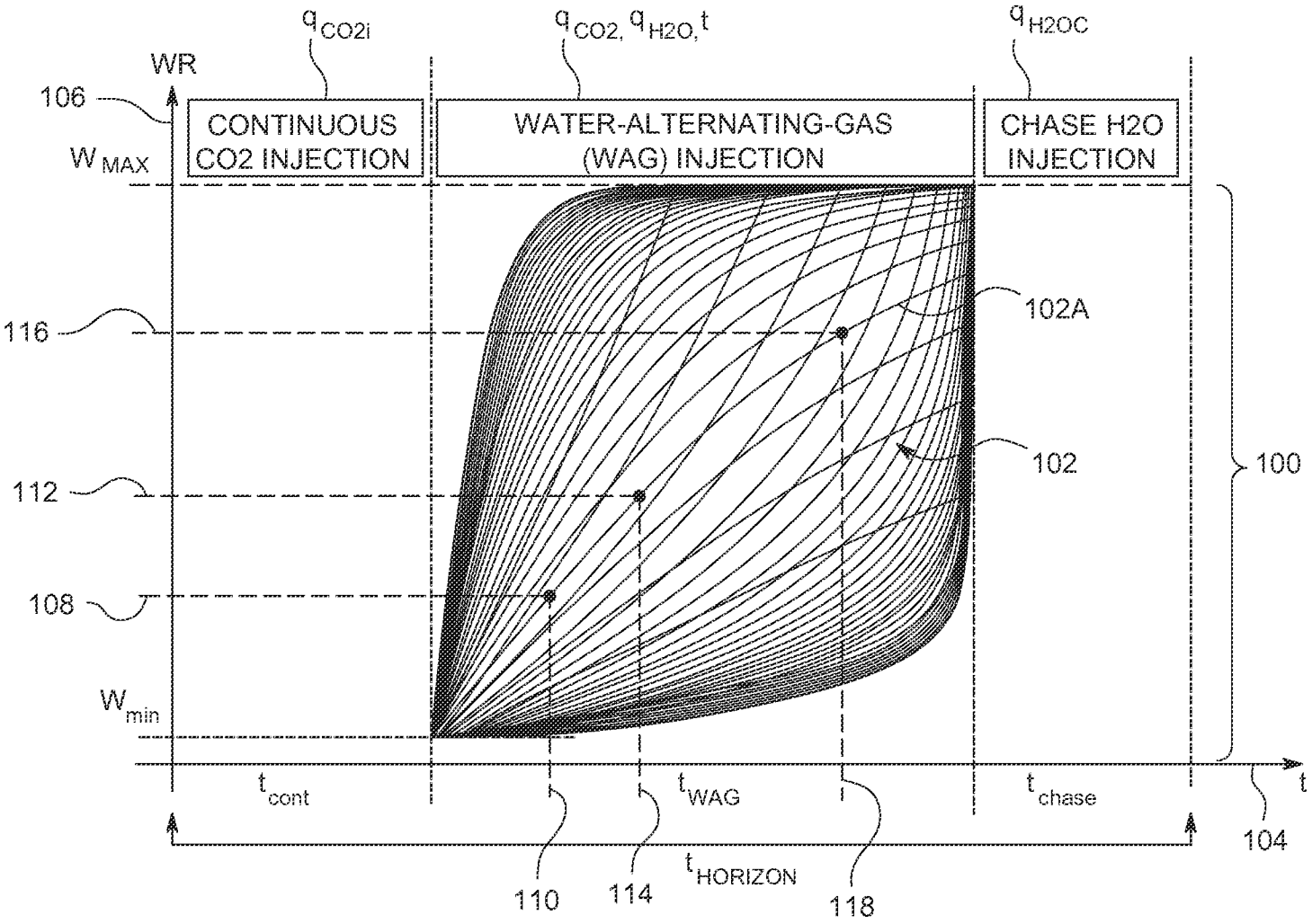
FIG. 1 illustrates a group of fluid-and-gas ratio functions according to one example.

One or more embodiments described herein provide systems and methods for designing and/or implementing fluid-and-gas ratio functions (also referred to herein as WAG schemes) that are customized to subterranean liquid resource reservoirs in order to increase the amount of liquid resources (e.g., oil) that are extracted from the reservoirs, while operating within constraints such as an amount of gas (e.g., CO2) that is available. The functions may be determined and implemented, and the outputs of the functions examined in order to further refine or modify the functions.

Some parameters used to control the extraction of the resources are the rates or amounts of a fluid (e.g., water) and a gas (e.g., CO2) being injected into the reservoir, the time at which the injectant (e.g., the fluid and the gas) being injected into the reservoir changes to the other injectant, and times at which to change the rates or amounts of the injectants and/or the times at which the injectants are switched. In one aspect of the subject matter described herein, the amounts of the fluid and gas and/or the rates at which the fluid and gas are separately injected into the reservoir are defined by a ratio of the fluid amount or rate to the gas amount or rate. The ratio may change with respect to time. For example, a fluid-and-gas or WAG ratio function can designate different fluid-to-gas ratios for different times. As time progresses, the ratio of fluid-to-gas that is injected into the reservoir changes.

The ratio function may increase the ratio of fluid to gas volumes that are injected into the reservoir over time, while the volume of gas that is injected into the reservoir remains constant (or decreases). Alternatively, the ratios may change in another manner. The ratio function may represent non-decreasing curves to reflect the increasing volumes of fluid being injected into the reservoir relative to the constant or decreasing volumes of gas being injected into the reservoir over time. The non-decreasing curves can be sigmoid functions or curves, an inverse exponential curve, or another type of decreasing curve.

In operation, the fluid and gas are alternatively injected into the reservoir at different times in amounts (or at rates) designated by the ratio function for the reservoir. As time passes, the ratio function dictates that different ratios be used. Periodically, continually, or randomly, the ratio function may be checked to determine if a different ratio be used. If so, the different ratio is used to change the injected volumes (or rates of injection) of the fluid and gas into the reservoir. This process may be repeated to repeatedly modify the ratio.

In one aspect, a family (e.g., group) of different ratio functions may be determined for the same reservoir. The ratio function being used to determine the ratio of fluid-to-gas being injected into the reservoir may be changed to a different ratio function. This change may occur in response to a supply of one or more of the injectants, such as the gas, changing (e.g., decreasing) and/or in response to the output of the resource being extracted from the reservoir decreasing below an expected or designated amount (e.g., a threshold associated with the ratio function, such as a cumulative amount of the resource that is expected to be extracted from the reservoir by using the ratio function up to a current time).

Some systems and methods described herein may create a customized fluid-and-gas ratio function (or groups of ratio functions) for a reservoir. The customized ratio function may be based on a variety of parameters, such as user-input constraints (e.g., limits on the amounts or rates of injecting fluids or gases), a type of ratio function, a limitation on a rate of change in the ratios designated by the first fluid-and-gas ratio function, a periodicity limitation on changes to the ratios designated by the first fluid-and-gas ratio function, a cycle time for alternating between injecting the fluid and injecting the gas into the reservoir, an update frequency at which the ratio designated by the fluid-and-gas ratio function is updated, an availability of the fluid, an availability of the gas, a cumulative amount of the liquid resource to be extracted from the reservoir, a designated time period in which to extract the cumulative amount of the liquid resource, a cumulative amount of the gas that is to be injected into the reservoir, a net value of the liquid resource that is to be extracted from the reservoir, and/or an available amount of the gas that is available for injection into the reservoir.

The ratio function or functions can be communicated to a central controller at the pumping location (e.g., the location where the fluid and gas are pumped into the reservoir by respective pumps). The central controller can repeatedly check the ratio function and direct pump controllers to control the injection of the fluid and gas into the reservoir according to the ratio currently designated by the ratio function. As the ratio function designates different ratios at different times, the controller can direct the pumps to correspondingly change the rates of injection or injected amounts of the fluid and the gas.

The ratio function being used can be checked by examining the amount or rate at which the resource is being extracted from the reservoir. If less than a desired or designated amount of the resource is being obtained using the ratio function, then the ratio function may be examined and potentially modified or replaced. The modification or replacement of the ratio function may be performed to try and find an "optimal" ratio function for the reservoir. An "optimal" ratio function may be a function that causes a larger amount of the resource to be obtained from the reservoir or a larger amount of the resource per unit of the gas being injected to be obtained from the reservoir relative to one or more other ratio functions, or relative to all other ratio functions.

The systems and methods described herein can help with increasing outcomes such as oil production, CO2 net utilization, CO2 storage, and field economic value, among others. In the absence of such a system or method, field operators use approximate schemes to determine the amounts of fluid and gas to inject based on intuition and observations alone, which are not guaranteed to identify optimal or better schemes. Thus, the systems and methods described herein can help oilfield operators to get more out of the CO2 recovery process and infrastructure. Currently, the industry using CO2 to extract oil purchases about 60 million tons of CO2 and extracts about 110 million barrels of oil annually. This translates to a CO2 net utilization rate of 10 Mcf/barrel across the industry.

Using one or more embodiments of the systems and methods described herein can increase the net utilization rate of CO2 by at least 5% and thereby impact approximately $110 to 438 million dollars via reduced CO2 purchases and/or increased oil production. The added flexibility of being able to use the systems and methods on a field-specific basis further allows customized field-specific strategies of CO2 usage. Additionally, the systems and methods allow for oilfield operators to monitor and track the oil recovery and injection parameters and, in the presence of deviations from the recommended strategies of the ratio functions (e.g., due to limited presence of CO2 or other causes), the systems and methods can be used to re-configure and/or update the ratio functions during extraction of the oil.

Figure 2A:
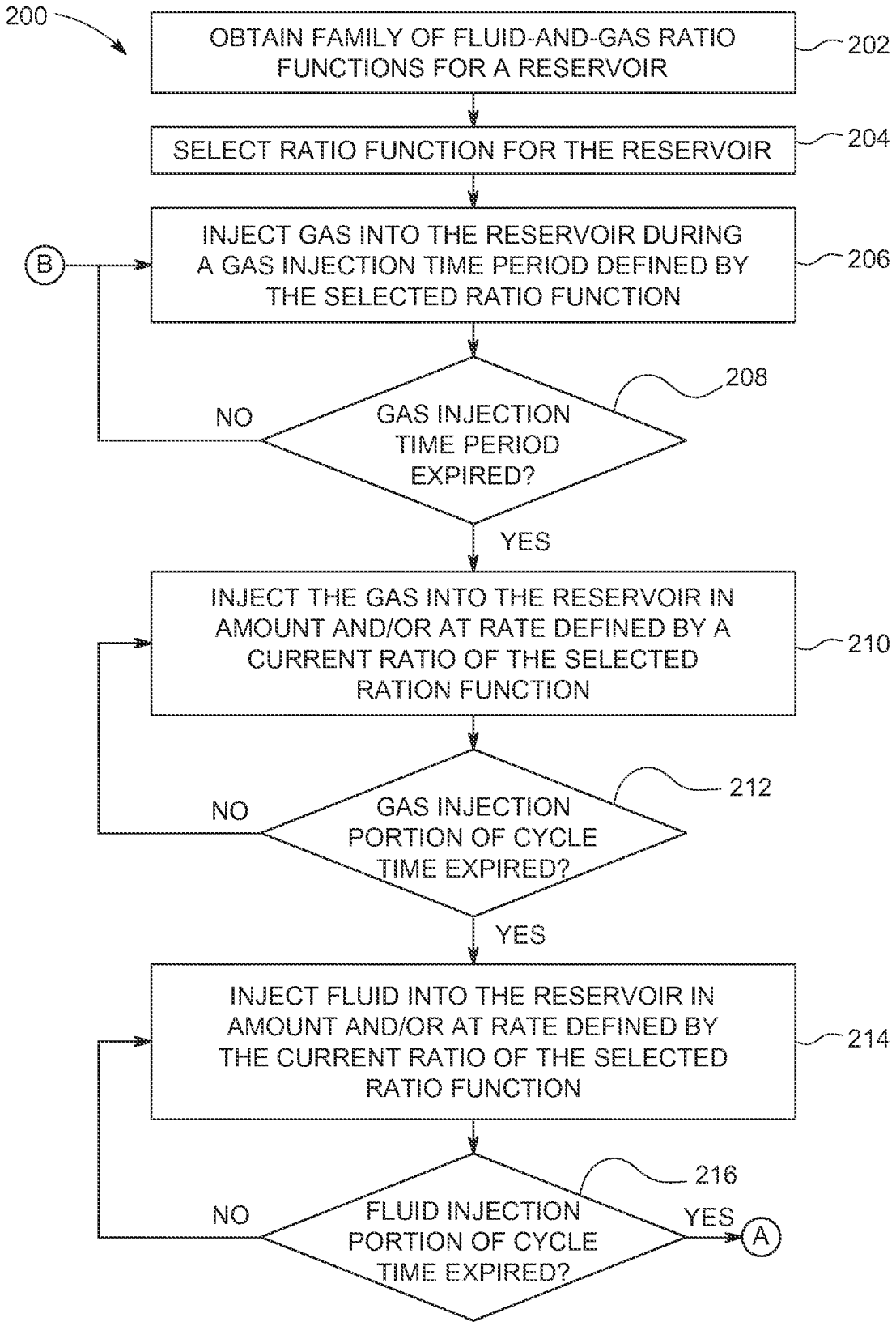
FIGS. 2A and 2B illustrate a flowchart of one embodiment of a method 200 for extracting a resource from a reservoir.
Figure 2B:
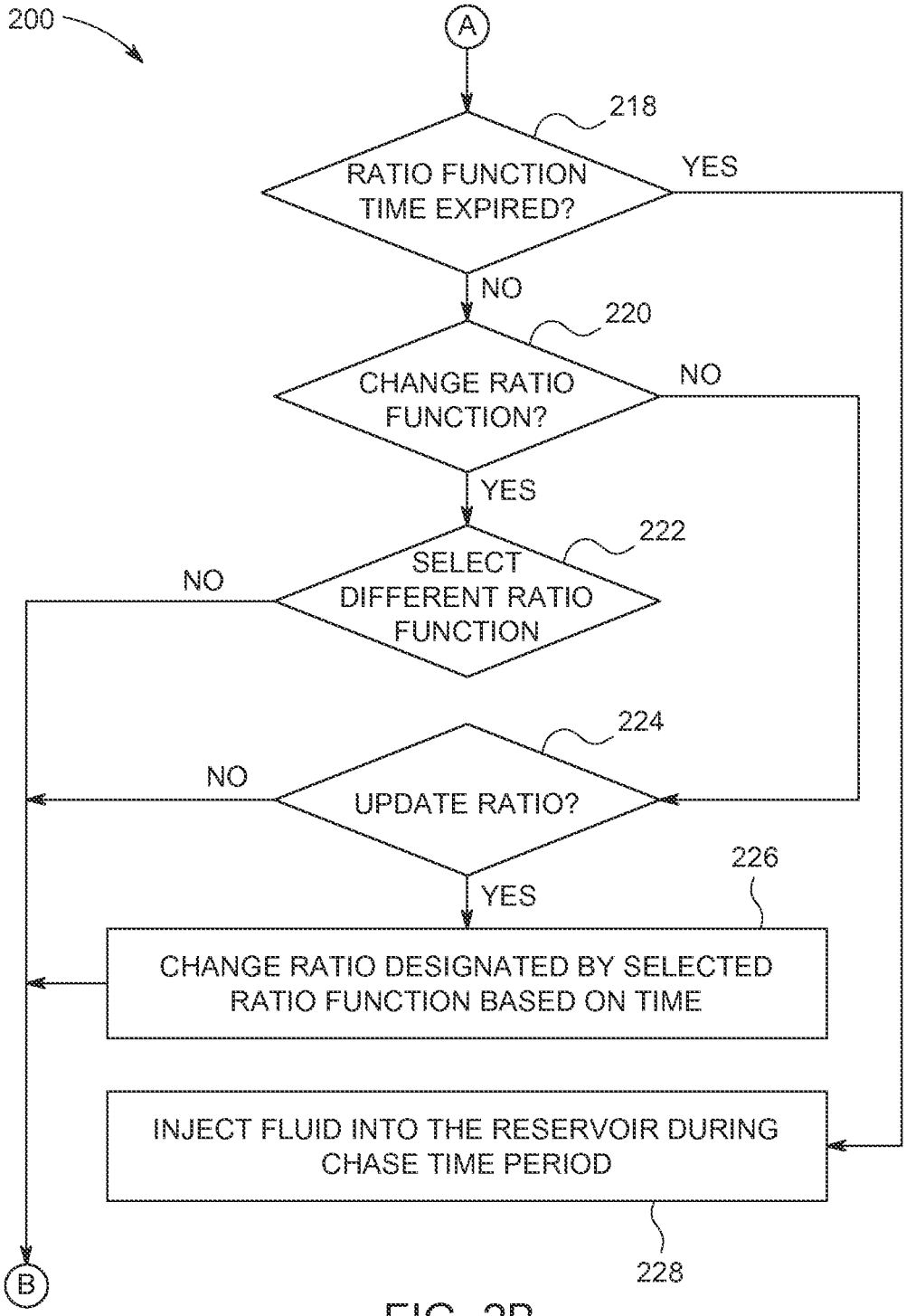

FIG. 1 illustrates a group 100 of fluid-and-gas ratio functions 102 according to one example. FIGS. 2A and 2B illustrate a flowchart of one embodiment of a method 200 for extracting a resource from a reservoir. The method 200 may be used to obtain a resource, such as oil, from a subterranean oil field (e.g., a reservoir). The method 200 may represent an algorithm and/or be used to generate a software program that controls computerized systems to pump fluid (e.g., water) and gas (e.g., CO2 or another gas) into the reservoir.

At 202, a family (e.g., the group 100) of fluid-and-gas ratio functions is obtained. In FIG. 1, the family of ratio functions 102 is shown alongside a horizontal axis 104 representative of time (represented as t in FIG. 1) and a vertical axis 106 representative of a ratio of an amount of fluid injected into a reservoir to an amount of gas injected into the reservoir (where the ratio is represented as WR in FIG. 1). The functions 102 can be obtained from a memory, such as the memory 310 shown in FIG. 3.

Different ratio functions 102 may be defined for different reservoirs based on resource extraction parameters. Optionally, the group 100 of the ratio functions 102 may be defined for the same reservoir. As shown in FIG. 1, the ratio functions 102 are non-decreasing curves. The ratios designated by the different ratio functions 102 do not decrease with increasing time. Alternatively, the ratio functions 102 may include one or more decreasing portions or curves.

The ratio functions 102 designate different ratios at different times. The ratios may be used to determine how much of a fluid (e.g., water) to inject into the reservoir during a cycle time (where half of a cycle time is represented in FIG. 1 as $t_h$) and how much of a gas (e.g., CO2) to inject into the reservoir during the same cycle time. During a single cycle (e.g., a single cycle time), the fluid may be injected into the reservoir during a first half of the cycle time and the gas may be injected into the reservoir during a second half of the cycle time. The fluid may not be injected while the gas is being injected, and the gas may not be injected while the fluid is being injected. Alternatively, both the fluid and gas may be injected concurrently for at least part of the cycle time.

As shown in FIG. 1, the functions 102 represent ratios that continually change with respect to time. For example, each of the functions 102 may not include the exact same ratio at two or more different times because the ratios continually change within the function 102. The continually changing ratios are represented by the smooth curve shapes of the functions 102. Alternatively, one or more of the functions 102 may not represent ratios that continually change with respect to time. For example, one or more of the functions 102 may include the exact same ratio at two or more different times. Such a function 102 may include one or more horizontally flat portions representative of the same ratios at different times.

At 204, a ratio function 102 is selected from the family of ratio functions 102. One of the ratio functions 102 may be selected for the reservoir, such as by a user or operator of the systems described herein. Optionally, a single ratio function 102 may be created and used for the reservoir, a ratio function 102 may be automatically selected (e.g., one of the ratio functions 102 may be a default function), etc. The gas is injected into the reservoir at a gas injection rate (represented as qco2 in FIG. 1). The selected ratio function 102 is used to determine the amounts of gas and fluid to be injected into the reservoir during each cycle time ($2*t_h$), or to determine the rates at which the gas and fluid are injected into the reservoir in order to provide the amounts designated by the ratio function 102. In the illustrated embodiments, the ratio functions 102 initiate at a start of a ratio function time period (represented as $t_{wag}$ in FIG. 1) with a lower (or minimum) non-zero fluid-and-gas ratio threshold or limit (represented as $w_{min}$ in FIG. 1) and terminate at an end of the ratio time period with an upper (or maximum) fluid-and-gas ratio threshold or limit (represented as $w_{max}$ in FIG. 1). The value of the lower fluid-and-gas ratio, the upper fluid-and-gas ratio, and/or the duration of the ratio time period may be based on an available amount of the gas, one or more characteristics of the reservoir, etc. For example, reservoirs having different amounts of resources, having different volumes, having different locations, etc., may have different lower and/or upper limits on the ratios. Alternatively, one or more of these ratios and/or time period may be customized for the reservoir based on other parameters. The ratios and/or time period may be the same for all of the ratio functions 102 in the group of ratio functions 102 that are customized for a reservoir, or two or more of the ratio functions 102 in the group of ratio functions 102 for the reservoir may have different upper limits, lower limits, and/or ratio function times. The limits and/or ratio function times may be determined for the ratio functions 102 of a reservoir to cause increased amounts of the resource to be removed from the reservoir relative to one or more (or all) other limits and/or ratio function time periods.

At 206, gas is injected into the reservoir during a continuous gas injection time period (represented as $t_{cont}$ in FIG. 1) that is defined by the selected ratio function 102. The gas can be injected into the reservoir at a gas injection rate (represented as $q_{co2i}$ in FIG. 1). In one aspect, one or more of the ratio functions 102 in the group of ratio functions for a reservoir include the continuous gas injection time period. The gas injection time period may be the same time period for all of the ratio functions 102 in the group of ratio functions 102 that are customized for a reservoir, or two or more of the ratio functions 102 in the group of ratio functions 102 for the reservoir may have different gas injection time periods. The gas injection time period may be determined for the ratio functions 102 of a reservoir to cause increased amounts of the resource to be removed from the reservoir relative to one or more (or all) other gas injection time periods for the reservoir.

At 208, a determination is made as to whether the gas injection time period has expired. If the time period has expired, then flow of the method 200 can proceed to 208. Otherwise, gas can continue to be injected into the reservoir and flow of the method 200 can return to 206. At 210, the gas is injected into the reservoir at an amount and/or at a rate of a current ratio designated by the selected ratio function. During injection of the gas at 208, the gas is injected without the fluid also being injected. Alternatively, the gas and fluid may be concurrently injected.

At 212, a determination is made as to whether a first part (e.g., the first half or other fraction) of the cycle time has expired. The first part may be referred to as a gas injection portion of the cycle time. If the gas injection portion of the cycle time has expired, then flow of the method 200 can proceed toward 214 to begin injecting fluid into the reservoir. But, if the gas injection portion of the cycle time has not expired, then flow of the method 200 can return toward 210 to continue injecting gas into the reservoir.

At 214, fluid is injected into the reservoir at an amount and/or at a rate of the current ratio designated by the fluid-and-gas ratio function. The fluid may be injected without the gas also being injected. Alternatively, the fluid and the gas may be concurrently injected. During the ratio function time period, the fluid is injected into the reservoir at a fluid injection rate (represented as $q_{h2o}$ in FIG. 1). Because the functions 102 can define different ratios for different times (and may define ratios that continually change with respect to time such that the same ratio is not defined at different times), the ratio designated by the selected function 102 during the time that the fluid is injected at 214 may differ from the ratio designated by the selected function 102 during the time that the gas is injected at 210.

At 216, a determination is made as to whether a second part (e.g., the second half or other fraction) of the cycle time has expired. This second part of the cycle time can be referred to as a fluid injection portion of the cycle time. In one embodiment, upon completion of a cycle time, the ratio of the total amount of fluid that was injected into the reservoir during the preceding cycle time to the total amount of gas that was injected into the reservoir during the preceding cycle time is the same as (or within a designated error tolerance of 1%, 3%, 5%, or the like) the ratio designated by the ratio function for the cycle time. If the fluid injection portion of the cycle time has expired, then flow of the method 200 can proceed toward 218 (shown in FIG. 2B). But, if the fluid injection portion of the cycle time has not expired, then flow of the method 200 can return toward 214 to continue injecting fluid into the reservoir.

At 218, a determination is made as to whether the ratio function time period ($t_{wag}$ in FIG. 1) has expired. If the ratio function time period has completed, then the injecting of fluid and gas in the alternating matter described above may terminate, and flow of the method 200 can proceed toward 228. At 228, the fluid is injected into the reservoir during a chase time period (represented as $t_{chase}$ in FIG. 1). The fluid may be injected without injecting the gas into the reservoir during the chase time period.

In one aspect, one or more of the ratio functions 102 in the group of ratio functions for a reservoir include the chase time period. The chase time period may be the same time period for all of the ratio functions 102 in the group of ratio functions 102 that are customized for a reservoir, or two or more of the ratio functions 102 in the group of ratio functions 102 for the reservoir may have different chase time periods. The chase time period may be determined for the ratio functions 102 of a reservoir to cause increased amounts of the resource to be removed from the reservoir relative to one or more (or all) other chase time periods for the reservoir. The total time period that encompasses the continuous gas injection time period, the ratio function time period, and the chase time period may be referred to as a time horizon (represented as $t_{horizon}$ in FIG. 1).

Returning to the description of 218 of the method 200, if the ratio function time period has not yet expired, then flow of the method 200 can proceed toward 220. At 220, a determination is made as to whether the ratio function currently being used to determine the ratio of fluid and gas being injected into the reservoir should be changed. The ratio function may be changed when one or more parameters change. As one example, the amount of the resource being extracted from the reservoir may be less than expected. Different ratio functions may be associated with lower threshold amounts of the resource that is expected to be removed from the reservoir at different times (when the associated ratio function is used). If the cumulative amount of the resource removed from the reservoir up to the time at which 220 occurs (using the current ratio function) is less than the threshold amount associated with the ratio function (up to the time at which 220 occurs), then the ratio function may be switched to another ratio function.

In another example, the pumping the gas and fluid into one reservoir may impact one or more other reservoirs. A field (e.g., an oil field) may include several interconnected reservoirs. Pumping fluid and gas into one reservoir can change the amount of resource (e.g., oil) in one or more other reservoirs and/or can change the output of the one or more other reservoirs having fluid and gas pumped into the one or more other reservoirs. For example, the fluid and/or gas being pumped into one reservoir can travel into another reservoir and/or some of the resource in one reservoir may be forced by the fluid and/or gas into another reservoir. These types of inter-reservoir impacts of pumping fluid and/or gas into a reservoir can cause a change in the ratio function being used for the reservoir. The output of the reservoir may not be as large or may be larger than expected (e.g., than the threshold described above) for the ratio function. As a result, a change in the ratio function being used may be implemented so that the output of the reservoir is increased or modified to be at least as large as a threshold associated with the updated ratio function.

As another example, the amount of available gas and/or fluid may change, and this change may cause a switch in which ratio function 102 is used to define the ratio of fluid and gas being injected into the reservoir. The amount of gas may change due to new and/or different gas supply equipment being available (e.g., compressors, pumps, etc.), deterioration in the health of the gas supply equipment, an increased cost in the gas, etc. The amount of gas may change due to changes in how much gas is used in one or more other reservoirs. For example, a finite amount of gas may be available at a field having several reservoirs. This gas may be allocated among the different reservoirs for injecting into the reservoirs according to ratio functions being used at the different reservoirs. If the amount of gas used at a first reservoir changes from an expected amount (e.g., by changing the ratio function being used at the first reservoir), then the ratio function being used at a second reservoir may change in order to account for more or less gas being available. If the first reservoir changes ratio functions such that the first reservoir is receiving more gas, then the ratio function for the second reservoir may change so that less gas is injected into the second reservoir. Conversely, if the first reservoir changes ratio functions such that the first reservoir is receiving less gas, then the ratio function for the second reservoir may change so that more gas is injected into the second reservoir. The currently used ratio function 102 may be based on an amount of gas that is different from the amount of gas that is currently available. The ratio function 102 can be switched to another ratio function 102 that is based on the new amount of gas that is available.

If the ratio function currently being used at a reservoir is to change, then flow of the method 200 can proceed to 222. At 222, another ratio function is selected. The ratio function can be selected based on the new or updated parameters described above (e.g., change in equipment, change in gas supply, inter-reservoir impacts, etc.). Flow of the method 200 can then return to 206 (shown in FIG. 2A). If ratio function currently being used at the reservoir is not to change, then flow of the method 200 can proceed toward 224.

At 224, a determination is made as to whether the ratio designated by the ratio function needs to be updated. The selected ratio function 102 can be used to repeatedly update the ratio during the ratio function time period. The ratio functions 102 designate different ratios as a function of time such that different ratios are used at different times. For example, with a first ratio function 102A, a first ratio 108 is used at a first time 110, a larger, second ratio 112 is used at a subsequent, second time 114, and a third ratio 116 is used at a subsequent, third time 118. The larger ratios indicate that increasingly more fluid is being injected into the reservoir and increasingly less gas is being injected into the reservoir.

The fluid and gas may be injected in the amounts or at the rates defined by the ratio designated by the ratio function 102 from a previous (e.g., the most recent) update. After a designated number of cycle times (e.g., two cycle times, or four half cycle times), the ratio function 102 may be checked to determine if a different ratio is to be used. Alternatively, the designated number of cycle times may have another value, or the ratio function 102 may be continually checked to determine the ratio. For example, the ratio may be updated as the fluid or gas is being injected into the reservoir, instead of waiting for a designated number of cycle times to occur. This can result in the rates of injection and/or amounts of the fluid and gas injected into the reservoir continually changing instead of changing only at designated times (e.g., after expiration of one or more cycle times).

If the designated number of cycle times has not completed or occurred since the last update to the ratio, then the fluid and gas may continue to be injected into the reservoir in the amounts and/or at the rates designated by the ratio function and flow of the method 200 can return toward 206 (shown in FIG. 2A) so that the fluid and gas can continue to be injected according to the current ratio. If the designated number of cycle times has completed or occurred since the last update to the ratio, then flow of the method 200 may proceed to 226 to update the ratio. The ratio may be updated at every update ratio time or at an update frequency. Alternatively, the ratio may be updated at other times. If the ratio is not to be updated, then flow of the method 200 can return toward 206 (shown in FIG. 2A).

At 226, the ratio of fluid-to-gas that is being injected into the reservoir according to the ratio function is updated. The ratio may be updated based on an elapsed time. For example, if the first ratio 108 was used for the previous cycle time and the time at which the ratio is updated is the second time 114, then the ratio that is used for one or more upcoming cycle times is the second ratio 112. If the ratio is eventually updated at the third time 118, then the third ratio 116 may be used for one or more cycle times after the third time 118. Upon updating the ratio, flow of the method 200 may return toward 206 (shown in FIG. 2A) to return to injecting gas and fluid into the reservoir according to the updated ratio designated by the ratio function.

Figure 3:
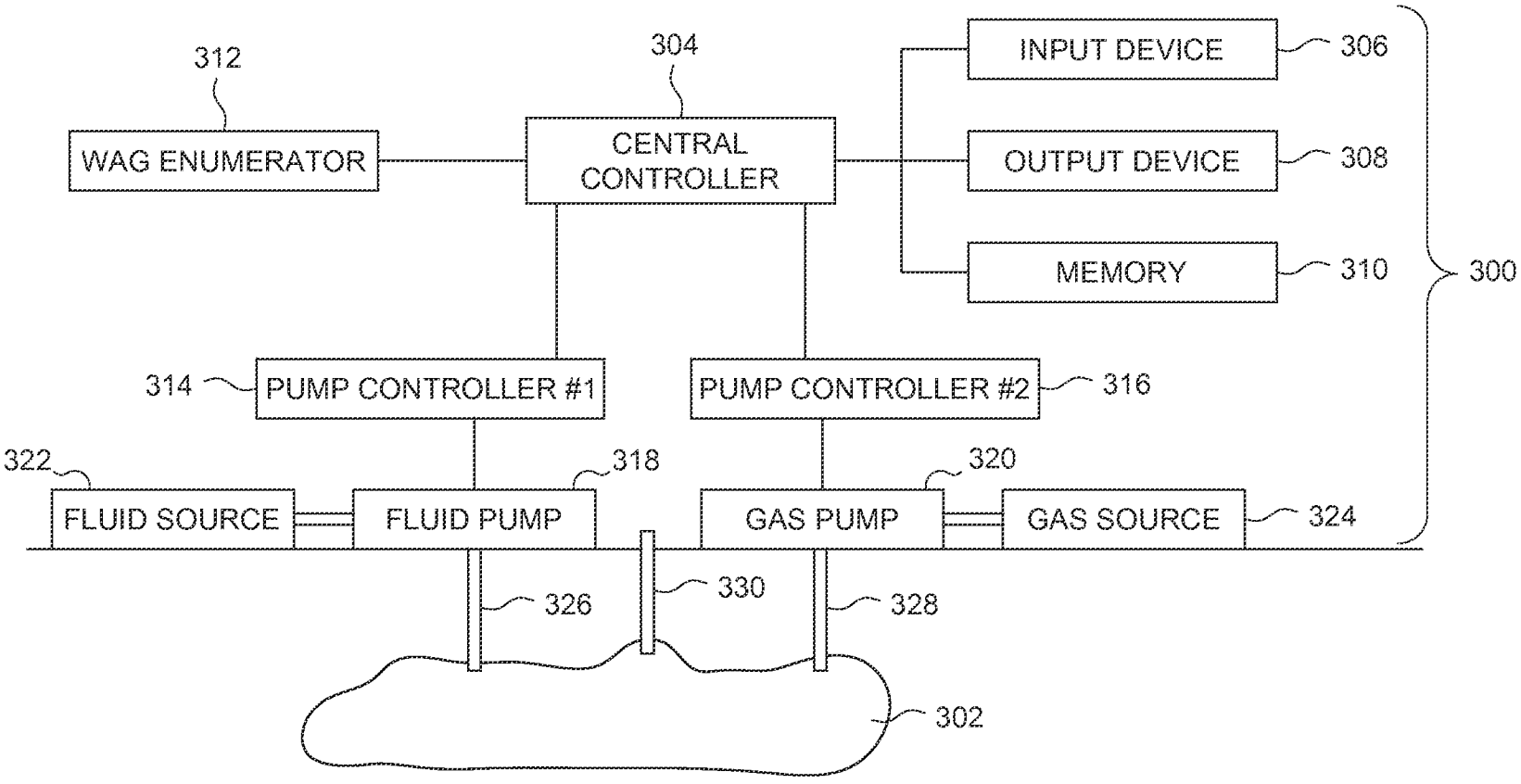
FIG. 3 illustrates one embodiment of a resource extraction system.

FIG. 3 illustrates one embodiment of a resource extraction system 300. The system 300 may be used to implement one or more of the ratio functions 102 (shown in FIG. 1) to extract a resource (e.g., oil) from a subterranean reservoir 302. The components shown in FIG. 3 can be communicatively coupled with one or more other components shown in FIG. 3 by one or more wired and/or wireless connections.

The system 300 includes a central controller 304, which can represent one or more processors (e.g., microprocessors, field programmable gate arrays, application specific integrated circuits, multi-core processors, or other electronic circuitry that carries out instructions of a computer program by carrying out arithmetic, logical, control, and/or input/output operations specified by the instructions. The instructions used to direct operations of the controller 304 may represent or be based on the flowchart of the method 200 and/or other operations described herein.

The controller 304 includes and/or is connected with an input device 306, such as an electronic mouse, keyboard, stylus, touchscreen, microphone, or the like. The input device 306 may receive information from an operator of the system 300, such as a selection of a fluid-and-gas ratio function, user-input constraints on one or more of injection of the fluid or injection of the gas into the reservoir, a type of ratio function, a limitation on a rate of change in the ratios designated by the first fluid-and-gas ratio function, a periodicity limitation on changes to the ratios designated by the first fluid-and-gas ratio function, the cycle time, an update frequency at which the ratio designated by the fluid-and-gas ratio function is updated, an availability of the fluid, an availability of the gas, or other information.

The controller 304 includes and/or is connected with an output device 308, such as a monitor, touchscreen (which may be the same component as the input device 306), a speaker, printer, or the like. The output device 308 may communicate information to the operator of the system 300, such as the ratio function, ratio functions other than or in addition to the selected ratio function, the ratio designated by the ratio function, the rates and/or amounts of fluid and/or gas that have been injected into the reservoir, the rates and/or amounts of fluid and/or gas that are currently being injected into the reservoir, the rates and/or amounts of fluid and/or gas that will be injected into the reservoir, remaining amounts of the gas and/or fluid, the amount of resource extracted from the reservoir, etc.

The controller 304 includes and/or is connected with a memory 310, such as a computer hard disc, read only memory, random access memory, optical disc, removable drive, etc. The memory 310 can store information such as ratio functions, ratios designated by the ratio functions, amounts of available gas and/or fluid, etc.

The controller 304 can communicate with a WAG enumerator 312 that provides ratio functions to the controller 304. As described below, the WAG enumerator 312 can create and/or modify the ratio functions based on various parameters and provide the ratio functions to the controller 304. The WAG enumerator 312 includes or represents one or more processors (e.g., microprocessors, field programmable gate arrays, application specific integrated circuits, multi-core processors, or other electronic circuitry that carries out instructions of a computer program by carrying out arithmetic, logical, control, and/or input/output operations specified by the instructions. The instructions used to direct operations of the WAG enumerator 312 may represent or be based on one or more flowcharts and/or other operations described herein.

The controller 304 communicates with pump controllers 314, 316 ("Pump Controller #1" and "Pump Controller #2" in FIG. 3) to control the rates of injection of the fluid and gas, the amounts of fluid and gas being injected into the reservoir, and/or the times at which the fluid and gas are injected into the reservoir. The controller 304 can direct each pump controller 314, 316 of the amount, rate, and/or timing of injecting the corresponding fluid or gas. In one aspect, the controller 304 can communicate change signals to the pump controllers 314, 316. The change signals may be communicated via one or more wired and/or wireless connections and can instruct the pump controllers 314, 316 of the rates and/or amounts of the fluid and gas that is to be injected into the reservoir 302.

The pump controllers 314, 316 are communicatively coupled with pumps 318, 320 that pump the fluid and gas. The pump 318 is a fluid pump that draws the fluid from a fluid source 322, such as a tank, reservoir (other than the reservoir 302), or body of water. The pump 320 is a gas pump that draws the gas from a gas source 324, such as a tank or other container. The pumps 318, 320 may be fluidly coupled with the reservoir 302 by one or more injection conduits 326, 328, such as wells, tubes, or the like. While the pumps 318, 320 are connected with the reservoir 302 by separate conduits 326, 328 in FIG. 3, alternatively, the pumps 318, 320 may be connected with the reservoir 302 by a single conduit. An extraction conduit 330 fluidly couples the reservoir 302 with space outside of the reservoir 302 (e.g., a location above the surface of the earth). The resource that is in the reservoir 302 may be extracted out of the reservoir 302 via the conduit 330 due to the pumping of the fluid and gas into the reservoir 302 via the conduits 326, 328.

Figure 4:
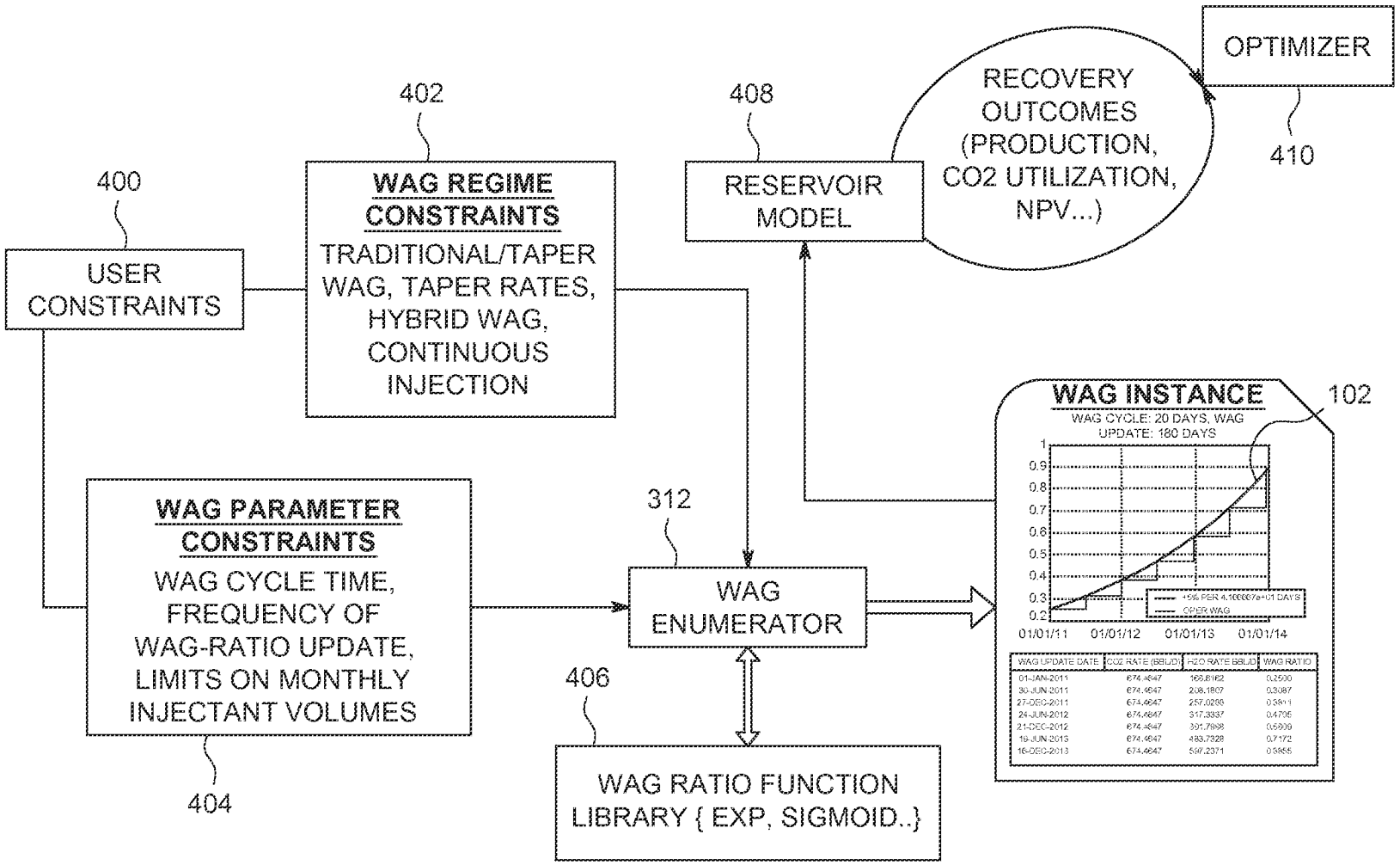
FIG. 4 illustrates operation of a WAG enumerator according to one embodiment.

FIG. 4 illustrates operation of the WAG enumerator 312 according to one embodiment. The enumerator 312 can create and/or modify ratio functions for reservoirs 302. The enumerator 312 can generate a ratio function as a continuous rate at which the ratio of fluid-to-gas being injected into the reservoir should change in order to control the reservoir to have an effective outcome of resource extraction. The enumerator 312 can create at least some of the ratio functions to be curves modeled from families of non-decreasing curves that result in ratios that increase the amount or injection rate of the fluid relative to that of the gas over time. In one aspect, the ratio functions are growth-exponential functions that asymptotically approach but do not reach and/or do not exceed a designated value, such as an upper limit on the ratio of fluid to gas (represented as $w_{max}$ in FIG. 1). Alternatively, the ratio functions may reach or exceed the upper limit. Optionally, one or more of the ratio functions may be curves of a different shape, such as curves based on sigmoid functions.

The enumerator 312 generates and/or modifies the ratio functions using resource extraction parameters. These parameters can include supply and field specific constraints, time horizon of interest for which the ratio function is to be used to extract the resource from the reservoir, outcomes of interest (which can be cumulative resource production, gas usage efficiency, field net-present-value, etc.), or the like. The resource extraction parameters may include inter-resource impacts of pumping fluid and/or gas into interconnected reservoirs in a field. For example, a parameter may indicate a change in the output of a resource from a first reservoir if fluid and/or gas is injected into one or more second reservoirs that are fluidly coupled or otherwise interconnected with the first reservoir. Another resource extraction parameter can include a limitation on how much gas is available to multiple reservoirs in a field, an allocation of gas among the reservoirs, or the like. The resource extraction parameters may be obtained by the enumerator 312 via an input device that is similar to the input device 306 and/or from a memory that is similar to the memory 310 shown in FIG. 3.

The resource extraction parameters can include user constraints 400, such as limitations on the rates of injection of the fluid and/or gas, limitations on the amounts of fluid and/or gas that may be injected, or other user-provided limitations. The rates of injection may be limited based on the equipment available at the reservoir. The amount of fluid and/or gas may be limited due to supply limitations.

The resource extraction parameters can include one or more fluid-and-gas regime constraints 402 ("WAG regime constraints" in FIG. 4), which may include one or more of a type of ratio function ("Traditional/taper wag" and "hybrid WAG" in FIG. 4), a limitation on a rate of change in the ratios designated by the fluid-and-gas ratio function ("taper rates" in FIG. 4), or a continual change indication on changes to the ratios designated by the fluid-and-gas ratio function ("continuous injection" in FIG. 4). The type of ratio functions can designate the shapes of the ratio function or functions. The limitations on the rates of change can include upper and/or lower limitations on how quickly the ratio of fluid-to-gas can change along one or more of the ratio functions for a reservoir. The continual change indication can indicate when the ratios are to be continually updated (and not just updated at the ends of designated numbers of cycle times).

The resource extraction parameters can include one or more fluid-and-gas parameter constraints 404 ("WAG parameter constraints" in FIG. 4). These constraints 404 can include a cumulative amount of the resource that is to be extracted from the reservoir. For example, a designated volume of the oil that is sought to be extracted from the reservoir may be indicated. The constraints 404 can include a designated time period in which to extract the cumulative amount of the resource. This time period can be a time limit on when extraction of the resource from the reservoir is to be completed. The constraints 404 can include a cumulative amount of the gas and/or the fluid that is to be injected into the reservoir during a designated time period ("Limits on monthly injectant volumes" in FIG. 4). For example, due to restrictions on how much gas is available for injection, the constraints 404 can prevent a ratio function from being created that causes more gas and/or fluid to be injected into the reservoir during a designated time period (e.g., every month) than is available for injecting into the reservoir during that time period. The constraints 404 may include a net value of the resource that is to be extracted from the reservoir. For example, this value can represent a current monetary value of oil that is sought to be extracted from the reservoir. The constraints 404 can include a limitation on how frequently the ratio of the fluid-to-gas that is injected into the reservoir is allowed to change ("Frequency of WAG-ratio update" in FIG. 4).

The enumerator 312 can examine the extraction parameters and determine what ratio functions are feasible for use to inject the fluid and gas into the reservoir while not violating the extraction parameters. The enumerator 312 can examine a memory 406 ("WAG ratio function library" in FIG. 4) that is similar to the memory 310 shown in FIG. 3 to identify which ratio functions can be used with the extraction parameters. The memory 406 may store ratio functions, and optionally may store previously used ratio functions for the same or other reservoirs. The enumerator 312 can compare features of the ratio functions to the extraction parameters to determine which ratio functions can be used with the extraction parameters.

For example, the enumerator 312 may avoid selecting ratio functions that would cause fluid and/or gas to be injected at rates or in amounts that exceed the limitations on the rates of injection of the fluid and/or gas, limitations on the amounts of fluid and/or gas that may be injected, or other user-provided limitations. The enumerator 312 also may avoid selecting ratio functions that do not match the type of ratio function identified by the parameters. For example, if the parameters 402 indicate that the ratio function should have the shape of an exponential function, then the enumerator 312 may not select a ratio function having the shape of a sigmoid curve. The enumerator 312 can avoid selecting ratio functions having rates of change in the ratios that exceed the limits on the rates of change in the parameters 402.

The enumerator 312 can select the ratio function or functions that will result in the resource being extracted from the reservoir in an amount that is at least as large as the cumulative amount designated by the constraints 404. This can be determined based on previous uses of the ratio functions (e.g., how much resource was extracted using the ratio functions before), by simulating use of the functions for the reservoir (e.g., based on previously measured rates of resource extraction from a reservoir, the amount of resource extracted using a ratio function can be estimated), or the like. The remaining extraction parameters also may be used to determine which of the ratio functions satisfy or violate the extraction parameters, and the enumerator 312 may select those ratio functions that satisfy the extraction parameters.

The group of ratio functions 102 that are selected as satisfying the extraction parameters can be evaluated by the enumerator 312 using a reservoir model 408. The model 408 can represent a computer-implemented simulation of using different functions of the selected ratio functions to extract resources from a reservoir. The simulation may involve examining the ratio functions that previously were used to extract resources from different reservoirs to determine the results of using the different ratio functions. For example, the enumerator 312 may examine previously used ratio functions to determine if the ratio functions are the same or similar to the ratio functions selected based on the resource extraction parameters. The previously used ratio functions may be similar to the selected ratio functions if one or more of the resource extraction parameters of the previously used ratio functions are the same as the selected ratio functions. The enumerator 312 also may examine the reservoirs from which the previous ratio functions were used to extract resources. These previous reservoirs may have characteristics that are similar to or the same as characteristics of a reservoir for which the enumerator 312 is attempting to determine the ratio functions (referred to as a current reservoir). For example, the previous and current reservoirs may have the same or similar (within a designated threshold, such as 1%, 3%, 10%, or the like) volume of resources, be of the same or similar size, be the same or similar depth beneath the surface of the earth, etc. The enumerator 312 can examine the previously used ratio functions and previous reservoirs to determine how the different ratio functions operated. The enumerator 312 can then estimate how the selected ratio functions for the current reservoir are likely to operate based on this history of previous ratio functions and reservoirs. In one aspect, the enumerator 312 can modify one or more aspects of the ratio functions based on the extraction parameters. For example, a previously used ratio function may need to be modified due to a limited supply of gas for injecting into a reservoir.

Based on this estimated performance of the different selected ratio functions, one or more of the selected ratio functions may be identified by the enumerator 312 as "optimized" ratio functions 410 ("Optimizer" in FIG. 4). An "optimized" ratio function includes a ratio function that is customized for a reservoir, which may or may not include the best possible ratio function for that reservoir. In one embodiment, an optimized ratio function may generate the largest possible amount of resources from a reservoir, but alternatively may not generate the largest possible amount.

The group of ratio functions 410 may then be presented to an operator of the system 300 for selection. The enumerator 312 can communicate the ratio functions 410 to the central controller 304 for presentation on the output device 308 and the operator of the system 300 may select a ratio function for implementation with a reservoir using the input device 306. Alternatively, the enumerator 312 may include the input and output devices 306, 308 for outputting the group of ratio functions and receiving a user selection of a ratio function.

Figure 5:
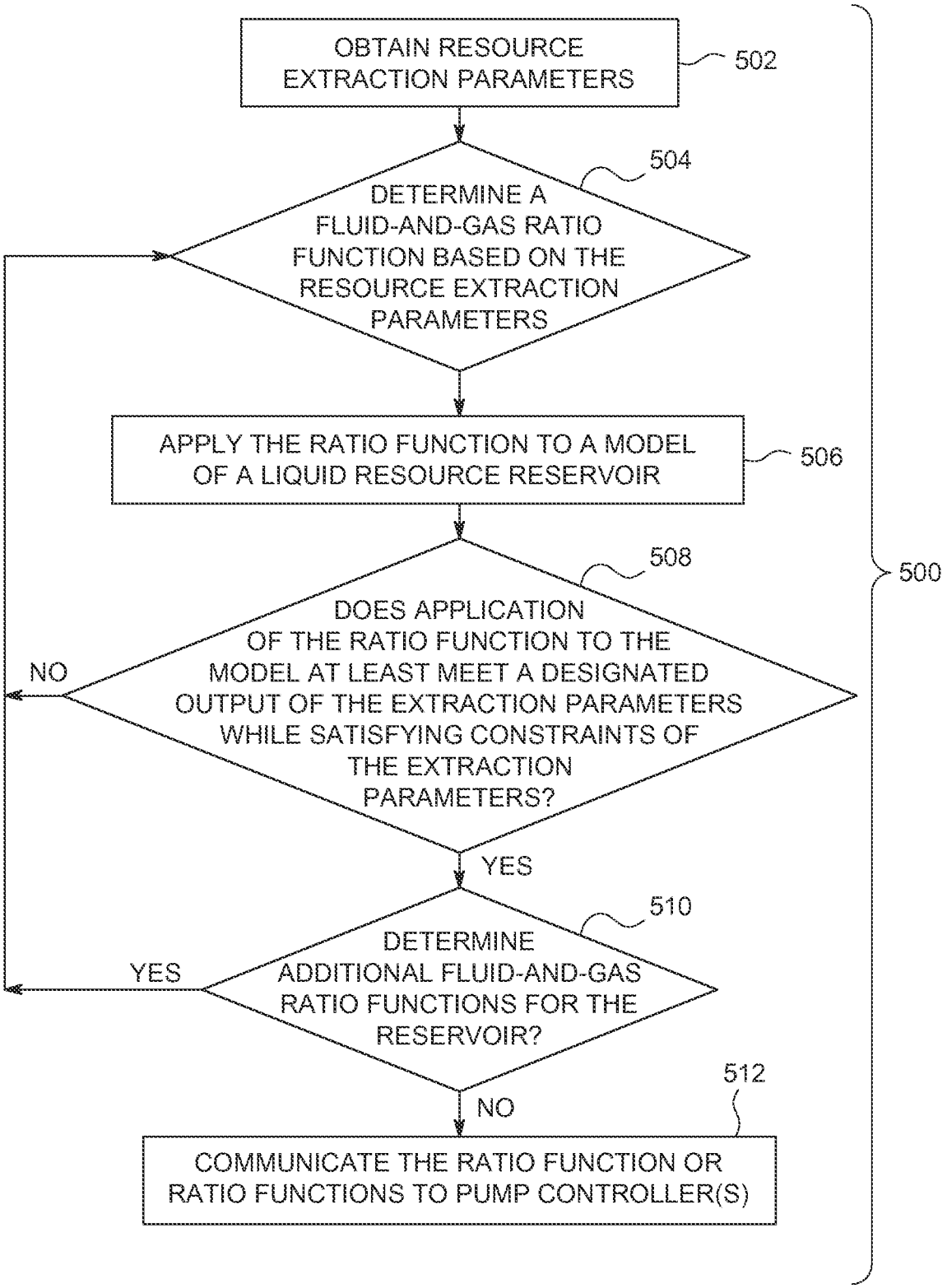
FIG. 5 illustrates a flowchart of a method for determining a ratio function for a reservoir.

FIG. 5 illustrates a flowchart of a method 500 for determining a ratio function for a reservoir. The method 500 may be used to identify ratio functions used to obtain a resource, such as oil, from a subterranean oil field. The method 500 may represent an algorithm and/or be used to generate a software program that determines customizes ratio functions for different reservoirs.

At 502, resource extraction parameters are obtained. The parameters may be obtained from a memory, from input provided by an operator of the system, or the like. The parameters can include characteristics of the reservoir, supplies of gas and fluid, limitations on the ratio functions that are to be customized for a reservoir, or the like, as described above. At 504, a fluid-and-gas ratio function is determined based on the resource extraction parameters. The ratio function can be selected by examining several ratio functions to determine which of the ratio functions satisfy requirements of the resource extraction parameters while avoiding violating limitations of the resource extraction parameters.

At 506, the selected ratio function is applied to a model of a reservoir. The ratio function may be applied to the model by simulating extraction of the resource from the reservoir using the ratio function. The simulation may be performed by estimating how much of the resource in the reservoir is estimated or calculated as being extracted if the ratio function is used to control injection of gas and fluid into the reservoir. The simulation may be based on previous extractions of resources from other reservoirs having common characteristics as a currently examined reservoir.

At 508, a determination is made as to whether application of the ratio function to the model of the reservoir meets at least a designated output of the extraction parameters while satisfying constraints of the extraction parameters. For example, the extraction parameters may provide a lower output limit that represents a lower limit on how much of the resource is to be extracted from the reservoir. If simulation of the ratio function does not result in at least the lower output limit being extracted from the reservoir, then the ratio function may be discarded from consideration. As a result, flow of the method 500 can return to 504 so that one or more additional ratio functions may be identified and evaluated as described above. If simulation of the ratio function does result in at least the lower output limit of the resource being extracted from the reservoir, then flow of the method 500 can proceed toward 510.

At 510, a determination is made as to whether any additional ratio functions are to be determined. For example, if no other ratio functions exist that satisfy the extraction parameters, then flow of the method 500 can proceed toward 512. As another example, if no other ratio functions exist that can be compared to the model of the reservoir, then flow of the method 500 can proceed toward 512. Otherwise, flow of the method 500 can return toward 504 so that one or more additional ratio functions may be identified and evaluated as described above.

At 512, the ratio function or functions are communicated to a pump controller. In one aspect, the ratio functions may be communicated to a system that includes the controller so that an operator or the controller can select a ratio function for implementation. The ratio function or functions may be implemented by the system to control the pumping of gas and fluid into the reservoir, as described above.

In one embodiment, a method (e.g., for extracting a resource from a reservoir) includes repeatedly alternating between injecting a fluid and injecting a gas into a liquid resource reservoir to cause a liquid resource in the reservoir to be extracted from the reservoir. One or more of a rate or an amount of each of the fluid and the gas that is injected into the reservoir is defined by a first fluid-and-gas ratio function that designates different ratios as a function of time. The ratios designate the one or more of the rate or the amount of the fluid that is injected into the reservoir to the one or more of the rate or the amount of the gas that is injected into the reservoir. The method also includes changing one or more of the rate or the amount at which one or more of the fluid or the gas is injected into the reservoir according to the ratios designated by the first fluid-and-gas ratio function as time progresses.

In one aspect, the reservoir is associated with a group of different fluid-and-gas ratio functions that includes the first fluid-and-gas ratio function and a different, second fluid-and-gas ratio function. The method also can include changing use of the first fluid-and-gas ratio function to using the second fluid-and-gas ratio function to determine the ratio of the one or more of the rate or the amount of the fluid that is injected to the one or more of the rate or the amount of the gas that is injected.

In one aspect, the first fluid-and-gas ratio function is customized for the reservoir and differs from a second fluid-and-gas ratio function defined for a different liquid resource reservoir.

In one aspect, injecting the fluid is performed automatically by a first pump and injecting the gas into the reservoir is performed automatically by a second pump according to the first fluid-and-gas ratio function.

In one aspect, the method also includes communicating change signals to a pump controller of one or more of the first pump or the second pump to automatically change the ratio of the one or more of the rate or the amount of the fluid being injected into the reservoir to the one or more of the rate or the amount of the gas being injected into the reservoir based on a change in elapsed time.

In one aspect, changing the one or more of the rate or the amount at which one or more of the fluid or the gas is injected into the reservoir according to the ratios designated by the first fluid-and-gas ratio function includes periodically examining the first fluid-and-gas ratio function to determine the ratio to be used and periodically changing the ratio of the one or more of the rate or the amount of the fluid that is injected into the reservoir to the one or more of the rate or the amount of the gas that is injected into the reservoir according to the ratio that is determined.

In one aspect, changing the one or more of the rate or the amount at which one or more of the fluid or the gas is injected into the reservoir according to the ratios designated by the first fluid-and-gas ratio function includes continually examining the first fluid-and-gas ratio function to determine the ratio to be used and continually changing the ratio of the one or more of the rate or the amount of the fluid that is injected into the reservoir to the one or more of the rate or the amount of the gas that is injected into the reservoir according to the ratio that is determined.

In one aspect, the first fluid-and-gas ratio function represents a non-decreasing relationship with respect to time between the one or more of the rate or the amount of the fluid that is injected into the reservoir to the one or more of the rate or the amount of the gas that is injected into the reservoir.

In one aspect, the first fluid-and-gas ratio function increases the one or more of the rate or the amount of the fluid that is injected into the reservoir while the one or more of the rate or the amount of the gas that is injected into the reservoir decreases or remains constant with respect to time.

In another embodiment, a system (e.g., a resource extraction system) includes a first pump controller configured to direct a fluid pump to inject a fluid into a liquid resource reservoir according to a first ratio designated by a first fluid-and-gas ratio function, and a second pump controller configured to direct a gas pump to inject a gas into the reservoir according to the first ratio designated by the first fluid-and-gas ratio function. The first fluid-and-gas ratio function designates different ratios that include the first ratio as a function of time. The ratios designate one or more of a rate or an amount of the fluid that is injected into the reservoir to one or more of a rate or amount of the gas that is injected into the reservoir. One or more of the first pump controller or the second pump controller is configured to change one or more of the rate or the amount at which one or more of the fluid or the gas is injected into the reservoir according to the ratios designated by the first fluid-and-gas ratio function as time progresses.

In one aspect, the reservoir is associated with a group of different fluid-and-gas ratio functions that includes the first fluid-and-gas ratio function and a different, second fluid-and-gas ratio function. The first pump controller and the second pump controller are configured to change use of the first fluid-and-gas ratio function to use of the second fluid-and-gas ratio function to determine the ratio of the one or more of the rate or the amount of the fluid that is injected to the one or more of the rate or the amount of the gas that is injected.

In one aspect, the first pump controller and the second pump controller are configured to automatically control pumping of the fluid and the gas into the reservoir according to the first fluid-and-gas ratio function.

In one aspect, the first pump controller and the second pump controller are configured to periodically change the ratio of the one or more of the rate or the amount of the fluid that is injected into the reservoir to the one or more of the rate or the amount of the gas that is injected into the reservoir based on the first fluid-and-gas ratio function.

In one aspect, the first pump controller and the second pump controller are configured to continually change the ratio of the one or more of the rate or the amount of the fluid that is injected into the reservoir to the one or more of the rate or the amount of the gas that is injected into the reservoir according to the first fluid-and-gas ratio function.

In another embodiment, a method for generating a ratio function includes obtaining resource extraction parameters related to extracting a liquid resource from a liquid resource reservoir by injecting a fluid and a gas into the reservoir and determining a first fluid-and-gas ratio function that designates different ratios as a function of time. The ratios designate one or more of a rate or an amount of the fluid that is injected into the reservoir to one or more of a rate or an amount of the gas that is injected into the reservoir, wherein the first fluid-and-gas ratio function is determined based on the resource extraction parameters. The method also can include directing a change in one or more of the rate of the fluid that is injected into the reservoir, the amount of the fluid that is injected into the reservoir, the rate of the gas that is injected into the reservoir, or the amount of the gas that is injected into the reservoir by communicating one or more of the first fluid-and-gas ratio function or a first ratio designated by the first fluid-and-gas ratio function for one or more of a current time or an upcoming time to a pump controller that controls the one or more of the rate of the fluid that is injected into the reservoir, the amount of the fluid that is injected into the reservoir, the rate of the gas that is injected into the reservoir, or the amount of the gas that is injected into the reservoir.

In one aspect, the first fluid-and-gas ratio function that is determined designates continual changes in the ratios as the function of time.

In one aspect, the resource extraction parameters include one or more user-input constraints on one or more of injection of the fluid or injection of the gas into the reservoir.

In one aspect, the resource extraction parameters represent one or more fluid-and-gas regime constraints and include one or more of a type of ratio function, a limitation on a rate of change in the ratios designated by the first fluid-and-gas ratio function, or a continual change indication on changes to the ratios designated by the first fluid-and-gas ratio function.

In one aspect, the resource extraction parameters represent one or more fluid-and-gas parameter constraints and include one or more of a cycle time for alternating between injecting the fluid and injecting the gas into the reservoir, an update frequency at which the ratio designated by the fluid-and-gas ratio function is updated, an availability of the fluid, or an availability of the gas.

In one aspect, the resource extraction parameters represent one or more designated outputs of the reservoir and include one or more of a cumulative amount of the liquid resource to be extracted from the reservoir, a designated time period in which to extract the cumulative amount of the liquid resource, a cumulative amount of the gas that is to be injected into the reservoir, a net value of the liquid resource that is to be extracted from the reservoir, or an available amount of the gas that is available for injection into the reservoir.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A method comprising:

obtaining a group of fluid-to-gas ratio functions from a memory, the group of fluid-to-gas ratio functions customized for a liquid resource reservoir, the fluid-to-gas ratio functions designating different ratios at which an amount of a fluid, wherein the fluid is water, to an amount of a gas are injected into the reservoir to extract a liquid resource from the reservoir, the fluid-to-gas ratio functions designating the ratios as continually changing and continually increasing ratios with respect to time subsequent to a continuous gas injection time period;

selecting a first fluid-to-gas ratio function;

repeatedly alternating between injecting the gas into the reservoir at one or more of a rate or an amount defined by a current ratio of the ratios designated by the first fluid-to-gas_ratio function that is selected and injecting the fluid into the reservoir at one or more of a rate or an amount defined by the current ratio; and changing the ratio at which the fluid and the gas are injected into the reservoir according to the first fluid-to-gas ratio function as time progresses.

2. The method of claim 1, wherein the fluid-to-gas ratio functions are customized for the reservoir in that the fluid-to-gas ratio functions are based on one or more parameters of the reservoir in order to increase an amount of the liquid resource that is extracted from the reservoir relative to extracting the liquid resource from the reservoir using one or more fluid-to-gas ratio functions not included within the group that was previously obtained from the memory.

3. The method of claim 1, wherein the fluid-to-gas ratio functions designate the ratios as the continually changing ratios with respect to time such that each of the fluid-to-gas ratio functions does not designate the same ratio of the ratios at two different times.

4. The method of claim 1, further comprising changing which of the fluid-to-gas ratio functions is used to designate the current ratio based on a change in one or more liquid resource extraction parameters.

5. The method of claim 1, further comprising injecting only the gas into the liquid reservoir for the continuous gas injection time period prior to repeatedly alternating between injecting the gas and injecting the fluid, wherein the fluid-to-gas ratios designate the continuous gas injection time period.

6. The method of claim 1, further comprising injecting only the fluid into the reservoir for a chase time period subsequent to completion of repeatedly alternating between injecting the gas and injecting the fluid, wherein the fluid-to-gas ratios designate the chase time period.

7. The method of claim 1, wherein injecting the fluid is performed automatically by a first pump and injecting the gas into the reservoir is performed automatically by a second pump according to the first fluid-to-gas ratio function.

8. The method of claim 7, further comprising communicating change signals to a pump controller of one or more of the first pump or the second pump to automatically change the ratio of the one or more of the rate or the amount of the fluid being injected into the reservoir to the one or more of the rate or the amount of the gas being injected into the reservoir based on a change in elapsed time.

9. The method of claim 1, wherein changing the one or more of the rate or the amount at which one or more of the fluid or the gas is injected into the reservoir according to the ratios designated by the first fluid-and-gas ratio function includes periodically examining the first fluid-to-gas ratio function to determine the ratio to be used and periodically changing the ratio of the one or more of the rate or the amount of the fluid that is injected into the reservoir to the one or more of the rate or the amount of the gas that is injected into the reservoir according to the ratio that is determined.

10. The method of claim 1, wherein changing the one or more of the rate or the amount at which one or more of the fluid or the gas is injected into the reservoir according to the ratios designated by the first fluid-to-gas ratio function includes continually examining the first fluid-and-gas ratio function to determine the ratio to be used and continually changing the ratio of the one or more of the rate or the amount of the fluid that is injected into the reservoir to the one or more of the rate or the amount of the gas that is injected into the reservoir according to the ratio that is determined.

11. The method of claim 1, wherein the first fluid-to-gas ratio function increases the one or more of the rate or the amount of the fluid that is injected into the reservoir while the one or more of the rate or the amount of the gas that is injected into the reservoir decreases or remains constant with respect to time.

12. A system comprising:

a controller having one or more processors configured to obtain a group of fluid-to-gas ratio functions from a memory, the group of fluid-and-gas ratio functions customized for a liquid resource reservoir, the fluid-to-gas ratio functions designating different ratios at which an amount of a fluid, wherein the fluid is water, to an amount of a gas are injected into the reservoir to extract a liquid resource from the reservoir, the fluid-to-gas ratio functions designating the ratios as continually changing and continually increasing ratios with respect to time subsequent to a continuous gas injection time period, the controller also configured to select a first fluid-to-gas ratio function and to communicate control signals to a fluid pump and a gas pump in order to repeatedly alternate between directing the gas pump to inject the gas into the reservoir at one or more of a rate or an amount defined by a current ratio of the ratios designated by the first fluid-to-gas ratio function that is selected and directing the fluid pump to inject the fluid into the reservoir at one or more of a rate or an amount defined by the current ratio, wherein the controller is configured to change the ratio at which the fluid and the gas are injected into the reservoir according to the first fluid-to-gas ratio function as time progresses.

13. The system of claim 12, wherein the fluid-to-gas ratio functions are customized for the reservoir in that the fluid-to-gas ratio functions are based on one or more parameters of the reservoir in order to increase an amount of the liquid resource that is extracted from the reservoir relative to extracting the liquid resource from the reservoir using one or more fluid-to-gas ratio functions not included within the group.

14. The system of claim 12, wherein the fluid-to-gas ratio functions designate the ratios as the continually changing ratios with respect to time such that each of the fluid-to-gas ratio functions does not designate the same ratio of the ratios at two different times.

15. The system of claim 12, wherein the controller is configured to change which of the fluid-to-gas ratio functions is used to designate the current ratio based on a change in one or more liquid resource extraction parameters.

16. A method comprising:

obtaining resource extraction parameters related to extracting a liquid resource from a liquid resource reservoir by injecting a fluid, wherein the fluid is water, and a gas into the reservoir;

customizing a group of fluid-to-gas ratio functions for the reservoir, each of the ratio functions designating ratios that continually change and that continually increase as a function of time subsequent to a continuous gas injection time period, the ratios designating one or more of a rate or an amount of the fluid that is injected into the reservoir to one or more of a rate or an amount of the gas that is injected into the reservoir, wherein the fluid-and-gas ratio functions are determined based on the liquid resource extraction parameters; and directing a change in one or more of the rate of the fluid that is injected into the reservoir, the amount of the fluid that is injected into the reservoir, the rate of the gas that is injected into the reservoir, or the amount of the gas that is injected into the reservoir by communicating one or more of the fluid-to-gas ratio functions to a controller that controls the one or more of the rate of the fluid that is injected into the reservoir, the amount of the fluid that is injected into the reservoir, the rate of the gas that is injected into the reservoir, or the amount of the gas that is injected into the reservoir.

17. The method of claim 16, wherein the liquid resource extraction parameters represent one or more fluid-and-gas regime constraints and include one or more of a type of ratio function, a limitation on a rate of change in the ratios designated by the first fluid-to-gas ratio function, or a continual change indication on changes to the ratios designated by the first fluid-to-gas ratio function.

18. The method of claim 16, wherein the liquid resource extraction parameters represent one or more fluid-and-gas parameter constraints and include one or more of a cycle time for alternating between injecting the fluid and injecting the gas into the reservoir, an update frequency at which the ratio designated by the fluid-to-gas ratio function is updated, an availability of the fluid, or an availability of the gas.

19. The method of claim 16, wherein customizing the group of the fluid-to-gas ratio functions for the reservoir includes determining a lower limit and an upper limit on the ratios of each of the fluid-to-gas ratio functions, wherein the lower limit and the upper limit are based on one or more characteristics of the reservoir.

20. The method of claim 16, wherein the liquid resource extraction parameters include one or more user-input constraints on one or more of injection of the fluid or injection of the gas into the reservoir.

* * * * *